US007506406B2

(12) United States Patent
Murayama et al.

(10) Patent No.: US 7,506,406 B2
(45) Date of Patent: Mar. 24, 2009

(54) DOOR CHECKER FOR AUTOMOBILE

(75) Inventors: Yuji Murayama, Saitama (JP); Junichi Yoshioka, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 264 days.

(21) Appl. No.: 11/278,887

(22) Filed: Apr. 6, 2006

(65) Prior Publication Data

US 2006/0230574 A1 Oct. 19, 2006

(30) Foreign Application Priority Data

Apr. 11, 2005 (JP) ..... 2005-113340

(51) Int. Cl.
*E05F 5/02* (2006.01)

(52) U.S. Cl. ..... 16/82; 16/86 C

(58) Field of Classification Search ..... 16/82, 16/85, 86 A, 86 B, 92, 64, 79, 354, 337; 312/319.1; 296/139
See application file for complete search history.

(56) References Cited

U.S. PATENT DOCUMENTS

| | | | | |
|---|---|---|---|---|
| 2,268,976 | A * | 1/1942 | Westrope | 16/86 C |
| 2,268,977 | A * | 1/1942 | Westrope | 16/86 C |
| 4,872,239 | A * | 10/1989 | Ferguson et al. | 16/64 |
| 4,999,872 | A * | 3/1991 | Jentsch | 16/58 |
| 5,205,016 | A * | 4/1993 | Kulot et al. | 16/82 |
| 5,206,971 | A * | 5/1993 | Schmelzer et al. | 16/62 |
| 5,862,570 | A * | 1/1999 | Lezuch et al. | 16/82 |
| 5,943,736 | A * | 8/1999 | Karkkainen et al. | 16/79 |
| 6,065,185 | A * | 5/2000 | Breed et al. | 16/86 C |
| 6,446,305 | B1 * | 9/2002 | Kneeland | 16/82 |
| 6,728,993 | B1 * | 5/2004 | Murayama | 16/342 |
| 6,848,759 | B2 * | 2/2005 | Doornbos et al. | 312/319.1 |
| 6,871,382 | B2 * | 3/2005 | Murayama et al. | 16/82 |
| 7,143,473 | B2 * | 12/2006 | Matsuki | 16/86 C |
| 2003/0101537 | A1 * | 6/2003 | Matsuki et al. | 16/85 |

FOREIGN PATENT DOCUMENTS

| | | | |
|---|---|---|---|
| DE | 10013583 | A1 * | 9/2001 |
| JP | 3-13392 | B2 | 2/1991 |
| KR | 2003092220 | * | 12/2003 |

* cited by examiner

*Primary Examiner*—Victor Batson
*Assistant Examiner*—Matthew Sullivan
(74) *Attorney, Agent, or Firm*—Arent Fox LLP

(57) ABSTRACT

A door checker for an automobile includes: a case fixed to one of a body and a door of the automobile; a check lever movably penetrating the case, oscillatably axis-supported by the other of the body and the door, and provided with a rack on one side face; a pinion meshed with the rack and rotatably housed in the case; a movable shoe housed in the case so that the movable shoe can be engaged with and disengaged from a tooth portion of the pinion; and a check spring for biasing the movable shoe in the direction of engagement with the pinion. The door is held at an arbitrary opening degree by an engaging force of the movable shoe with the pinion due to a biasing force of the check spring. Thus, it is possible to easily set a large number of steps in an opening degree for holding the door.

3 Claims, 13 Drawing Sheets

NON-HOLDING STATE

NON-HOLDING STATE

HOLDING STATE

CAM PLATE OPERATING

CAM PLATE OPERATION LIMIT

DOOR CHECKER FOR AUTOMOBILE

RELATED APPLICATION DATA

The present invention is based upon Japanese priority application No. 2005-113340, which is hereby incorporated in its entirety herein by reference.

BACKGROUND OF THE INVENTION

1. Field of the Invention

The present invention relates to improvement of a door checker for an automobile connected between a body and a door of the automobile for holding the door at a predetermined opening-degree position.

2. Description of the Related Art

A conventional door checker of this type is, as disclosed in the Japanese Patent Publication No. 3-13392, provided with a case fixed to one of a body and a door of an automobile, a check lever movably penetrating the case and connected to the other of the body and the door, a shoe holder which is held by the case and capable of advancing/retreating to/from the check lever, a shoe held by the shoe holder and sliding on the check lever with relative movement of the case and the check lever, and a check spring for springing back the shoe holder to the check lever side within the case so that the shoe is brought into pressure contact with the check lever, and a detent notch to be engaged with the shoe is formed on the check lever so that the door is stopped/held at a specified opening degree by an engaging force between the detent notch and the shoe.

In the above conventional door checker, the opening degree for holding the door can be set only in several stages, and thus the door can not be often held at an opening degree desired by a user.

SUMMARY OF THE INVENTION

The present invention has been achieved in view of the above circumstances and has an object to provide a door checker for an automobile which can easily set an opening degree for holding the door in a large number of steps so that the door can be held at the opening degree desired by the user.

In order to achieve the above object, according to a first feature of the present invention, there is provided a door checker for an automobile, comprising: a case fixed to one of a body and a door of the automobile; a check lever movably penetrating the case, oscillatably axis-supported by the other of the body and the door, and provided with a rack on one side face; a pinion meshed with the rack and rotatably housed in the case; a movable shoe housed in the case so that the movable shoe can be engaged with and disengaged from a tooth portion of the pinion; and a check spring for biasing the movable shoe in the direction of engagement with the pinion, wherein the door is held at an arbitrary opening degree by an engaging force of the movable shoe with the pinion due to a biasing force of the check spring.

With the first feature of the present invention, since the pinion in the case is rotated by the rack of the check lever according to the opening-degree change of the door so as to be engaged with any tooth portion of the pinion, the number of steps which can hold the door by the engaging force can be set to be large with ease depending on the number of rack teeth, and thus the door can be held at the opening degree desired by the user.

According to a second feature of the present invention, in addition to the first feature, shoe pushing-up means is provided in the case so as to separate the movable shoe from the pinion with relative movement of the case and the check lever.

With the second feature of the present invention, since the shoe pushing-up means is provided in the case so as to separate the movable shoe from the pinion with relative movement of the case and the check lever, when the door is swung from the held position, the contact between the movable shoe and the pinion is cut off, thereby preventing noise caused by the contact.

According to a third feature of the present invention, in addition to the first or second feature, a rotational axis of the pinion is arranged in parallel with an axis for oscillatably connecting the check lever to the other of the body and the door.

With the third feature of the present invention, since the rotational axis of the pinion is arranged in parallel with the axis of the check lever, the meshed state between the rack and the pinion of the check lever can be always kept normal even if a relative angle between the check lever and the case is changed according to the movement of the door, and thus the engagement state between the pinion and the movable shoe is not changed. Therefore, a force for holding the door can be always stabilized irrespective of the opening degree of the door.

DESCRIPTION OF THE PREFERRED EMBODIMENTS

The above-mentioned object, other object, characteristics, and advantages of the present invention will become apparent from preferred embodiments, which will be described in detail below by reference to the attached drawings.

Figure 1:
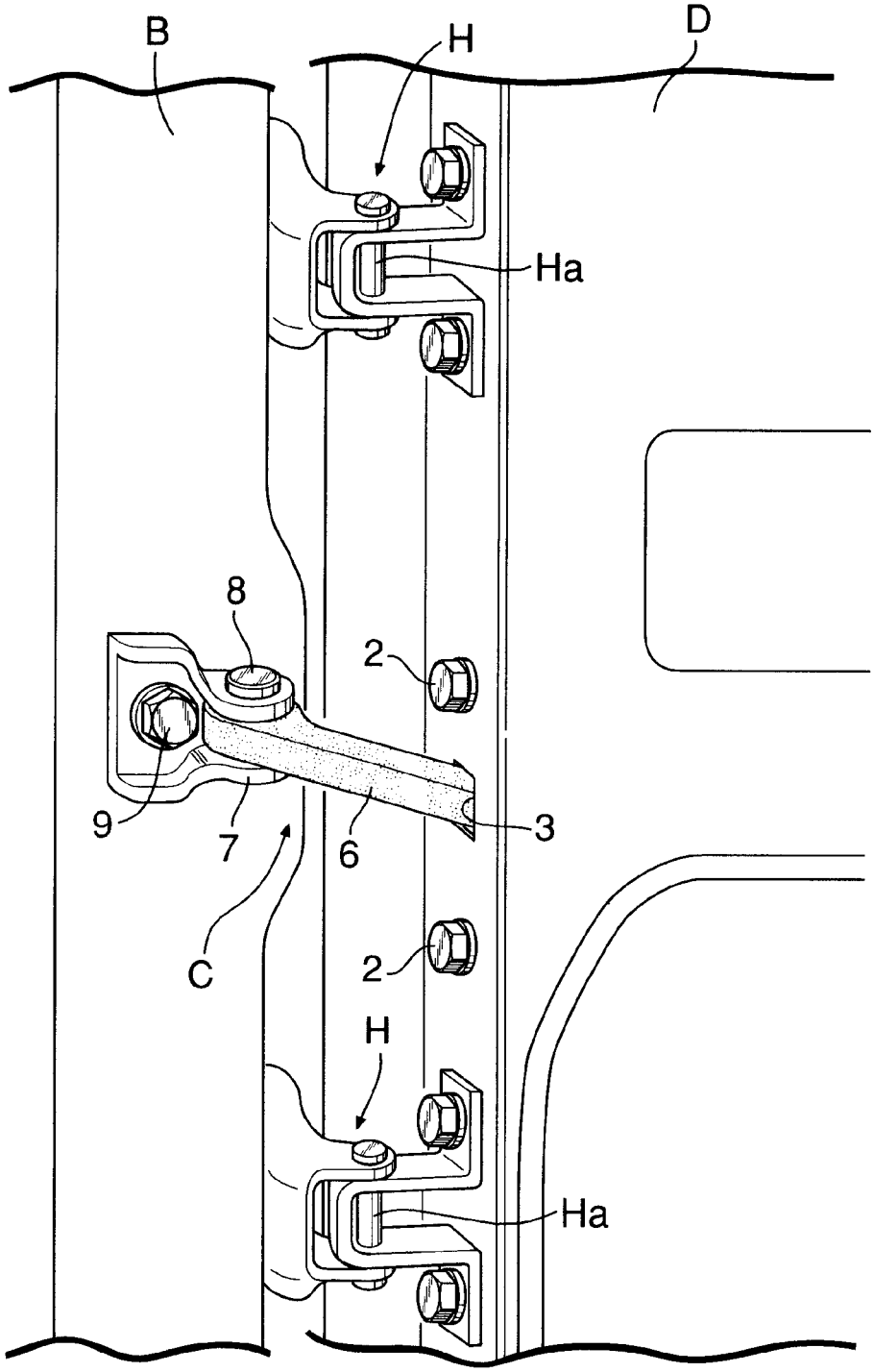
FIG. 1 is a perspective view of an essential part of an automobile equipped with a door checker according to a preferred embodiment of the present invention.

First, in FIG. 1, a door D is swingably mounted to a body B of an automobile so as to open/close an entrance thereof with a vertical pair of hinges H and H, and a door checker C of the present invention is mounted between the hinges H and H between the body B and the door D.

As shown in FIGS. 2 to 7, the door checker C has a case 1 fixed to an inner surface of an end wall of the door D with a bolt 2. The case 1 is constituted by a case body 1*a* having a box shape with one end opened and a cover 1*b* fixed to the end wall of the door D with the bolt 2 while covering the opened end. Provided on the cover 1*b* and the case body 1*a* are a through hole 3 opened on the end wall of the door D and coaxially aligned through holes 4 and 5. A base end of a check lever 6 penetrating these three through holes 3, 4 and 5 is connected to a bracket 7 through an axis 8 so that the check lever 6 and the bracket 7 are capable of mutual rotational movement. The bracket 7 arranges the axis 8 in parallel with a pivot shaft Ha of the hinge H, and is fixed to the body D with a bolt 9 (See FIG. 1).

The check lever 6 comprises a core plate 6*a* made of a steel plate extending over the entire length in its longitudinal direction, and an outer skin 6*b* made of a synthetic resin to be mold-bonded to a circumferential surface of the core plate 6*a*. At a free end of the check lever 6, full-open stopper means 12 for defining an open limit of the door D is provided. This full-open stopper means 12 comprises a stopper plate 13 penetrated by the free end of the check lever 6, a stopper pin 15 which is press-fit into a pin hole 14 provided at the free end of the check lever 6 so as to support a back surface of the stopper plate 13, and a cushion member 16 made of rubber and supported on the front surface of the stopper plate 13. When the door D is largely opened, an end wall of the case 1 is received by the stopper plate 13 through the cushion member 16, so that the full-open position of the door D is defined.

One side face of the check lever 6 in parallel with the axis 8 is divided into a non-holding section E corresponding to a section from the full-closed position of the door D to a predetermined small opening degree, and a holding section F corresponding to a section from the end of the non-holding section E to the full-open position of the door D. Projectingly provided on a side surface of the holding section F are a rack 17 and a pair of guide ribs 18 and 18 arranged on opposite sides of the rack 17. Opposite side edges of the core plate 6*a* rise so that they bite into the guide ribs 18 and 18. A side surface of the non-holding section E of the check lever 6 is a flat surface having the same level as a bottom surface of the rack 17, and the pair of guide ribs 18 and 18 extend to the side surface of this non-holding section E. Both outer portions of both the guide ribs 18 and 18 on the side surface of the check lever 6 are formed on a pair of flat rail surfaces 19 and 19 which are slightly lower than the bottom surface of the rack 17.

Provided in the case 1 are a pinion 20 capable of being meshed with the rack 17, a pivot 21 for rotatably support the pinion 20, a pair of friction plates 22 and 22 arranged on opposite outer sides of the pinion 20 and penetrated by the pivot 21, a pair of cam plates 23 and 23 arranged outside of these friction plates 22 and 22 and rotatably supported by the pivot 21, a pair of set springs 25 and 25 made of rubber, arranged outside of both the cam plates 23 and 23 with washers 24 and 24 therebetween and penetrated by the pivot 21, and a pair of support plates 26 and 26 fitted to opposite ends of the pivot 21 to contact with the inner opposite surfaces of the case 1 while compressing the set springs 25 and 25. The friction plates 22 and 22 are brought into pressure contact with the pinion 20 and the cam plates 23 and 23 by a compression reaction of the set springs 25. The friction plates 22 are molded from a friction material such as rubber, cork, brake lining material, clutch facing material, etc.

The support plates 26 and 26 are constituted so that movement of the check lever 6 in the longitudinal direction is limited by a bottom wall of the case body 1*a* and the cover 1*b*, but the movement of the check lever 6 in the direction orthogonal to the longitudinal direction is not prevented by the case 1. The check lever 6 side on the outer circumferential face of each of the cam plates 23 is formed into an arc surface 23*a* with the pivot 21 as its center. When the pinion 20 is in the non-holding section E of the check lever 6, the arc surface 23*a* rides on the rail surface 19 of the check lever 6 so as to break off contact of the pinion 20 with the check lever 6 (See FIGS. 2, 5 and 6); and when the pinion 20 is moved to the holding section F of the check lever 6, the arc surface 23*a* is raised from the rail surface 19 by meshing with the rack 17 (See FIGS. 3 and 8).

Further provided in the case 1 are a fixed shoe 30 slidably supporting the side surface of the check lever 6 opposite to the rack 17, a movable shoe 31 opposed to the fixed shoe 30 with the pinion 20 and the check lever 6 therebetween, and a check spring 32 made of rubber for springing back the movable shoe 31 toward the pinion 20 and the cam plates 23 and 23.

The fixed shoe 30 is fixed within the case 1, while the movable shoe 31 is capable of sliding on the inner surface of the case 1 so that it can advance/retreat to/from the fixed shoe 30. A projection 31*a* is integrally formed on the movable shoe 31 so as to apply a rotational resistance to the pinion 20 by being engaged between tooth portions 20*a* and 20*a* of the pinion 20.

Moreover, a pair of peak portions 23*b* and 23*b* arranged so as to hold the projection 31*a* therebetween are provided on each of the cam plates 23. Both the peak portions 23*b* and 23*b* are formed with their top portion protruding higher than the tooth portion 20*a* of the pinion 20, and a valley portion between both the peak portions 23*b* and 23*b* is made deep so as not to prevent the engagement of the projection 31*a* between the tooth portions 20*a* and 20*a* of the pinion 20.

Furthermore, the cam plate 23 is provided with a pair of stopper claws 23*c* and 23*c* which are brought into contact with the inner surface of the case 1 so as to limit a rotational angle around the pivot 21 of the cam plate 23 to a constant value. When the cam plate 23 is rotated till each of the stopper claws 23*c* is brought into contact with the inner wall of the case 1, an inclined surface of one of the peak portions 23*b* separates the projection 31*a* of the movable shoe 31 from the tooth portion 20*a* of the pinion 20. At this rotation limit of the cam plate 23, a repulsive force of the check spring 32 generates a component force $f_2$ with which the projection 31*a* goes down the inclined surface of the peak portion 23*b* because the peak portion 23*b* holds the projection 31*a* at the middle of the inclined surface (see FIG. 11).

In the above embodiment, the friction plate 22, the cam plate 23 and the set spring 25 constitute shoe pushing-up means L for separating the movable shoe 31 from the pinion 20 with relative movement of the case 1 and the check lever 6.

Next, operation of this preferred embodiment will be described.

Figure 2:
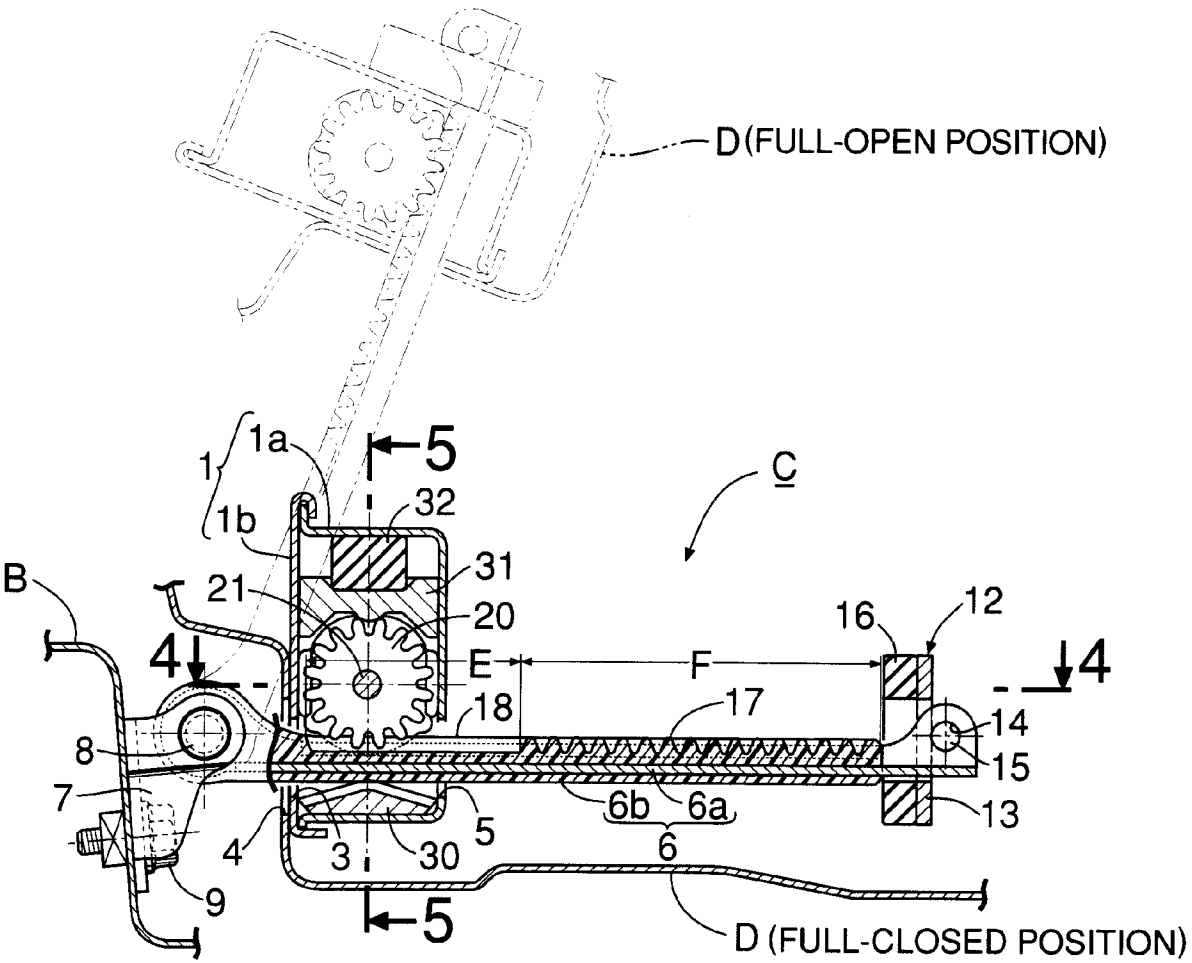
FIG. 2 is a plan view of the door checker shown in the state where the door is not held.
Figure 5:
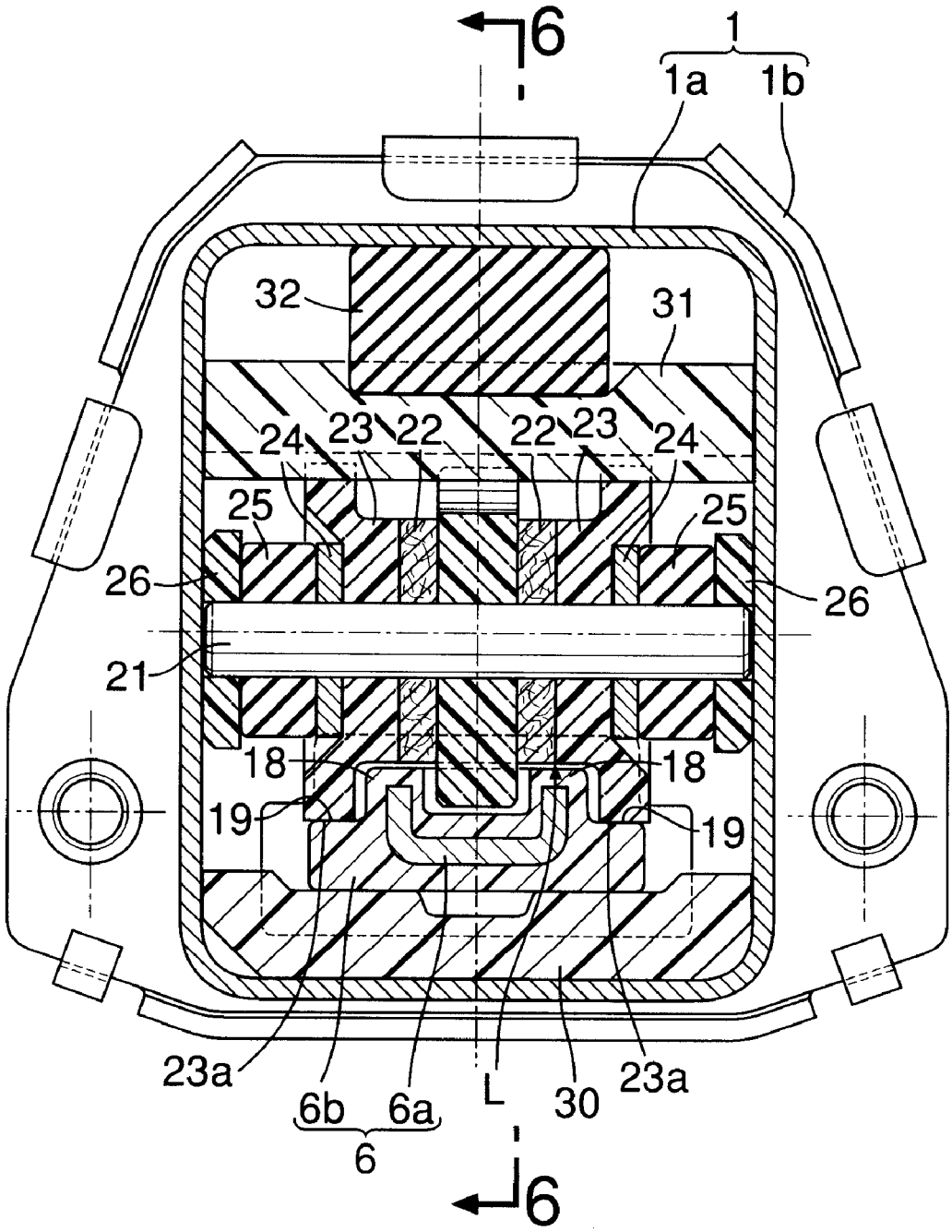
FIG. 5 is an enlarged sectional view along 5-5 line in FIG. 2.
Figure 6:
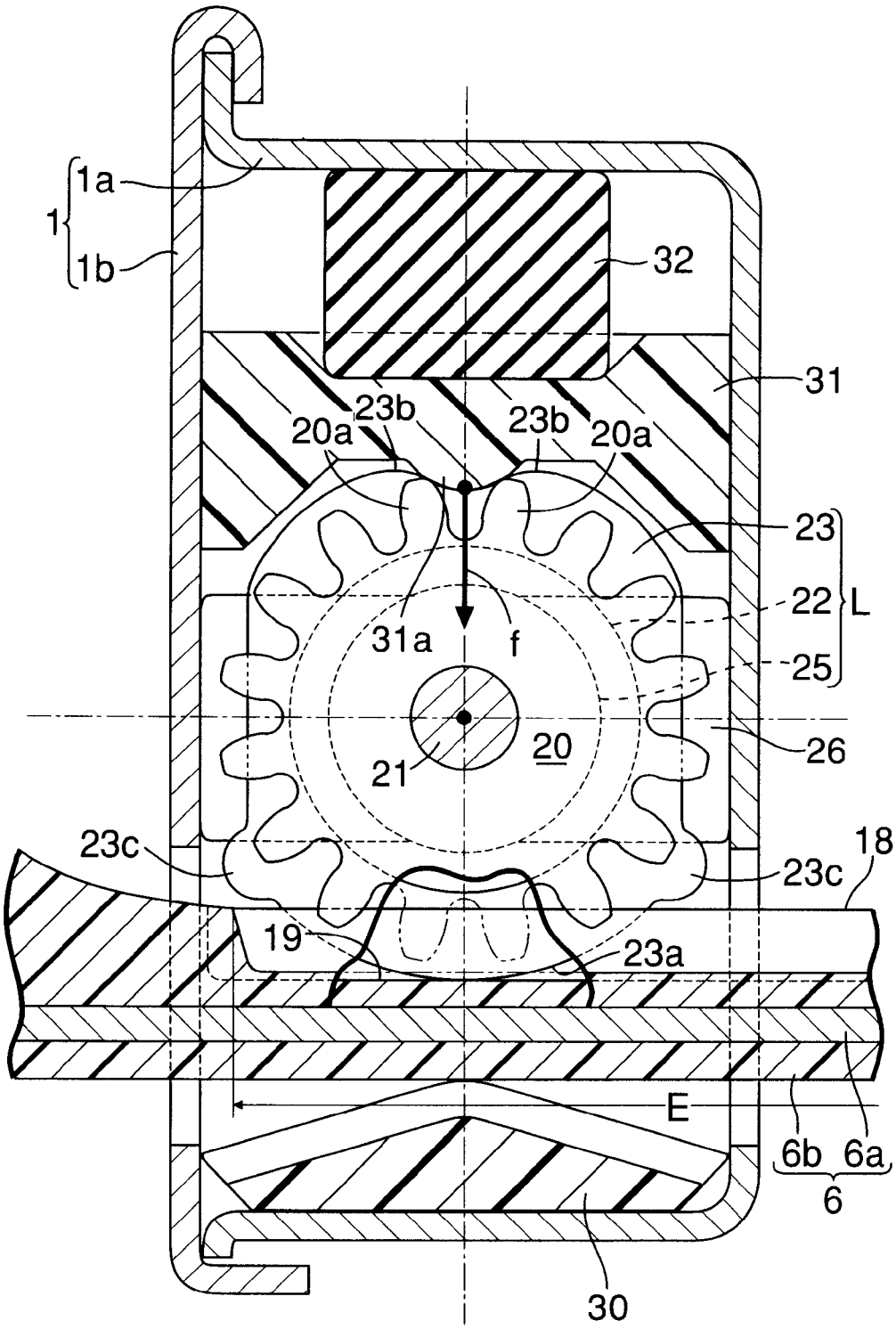
FIG. 6 is a sectional view along 6-6 line in FIG. 5.
Figure 7:
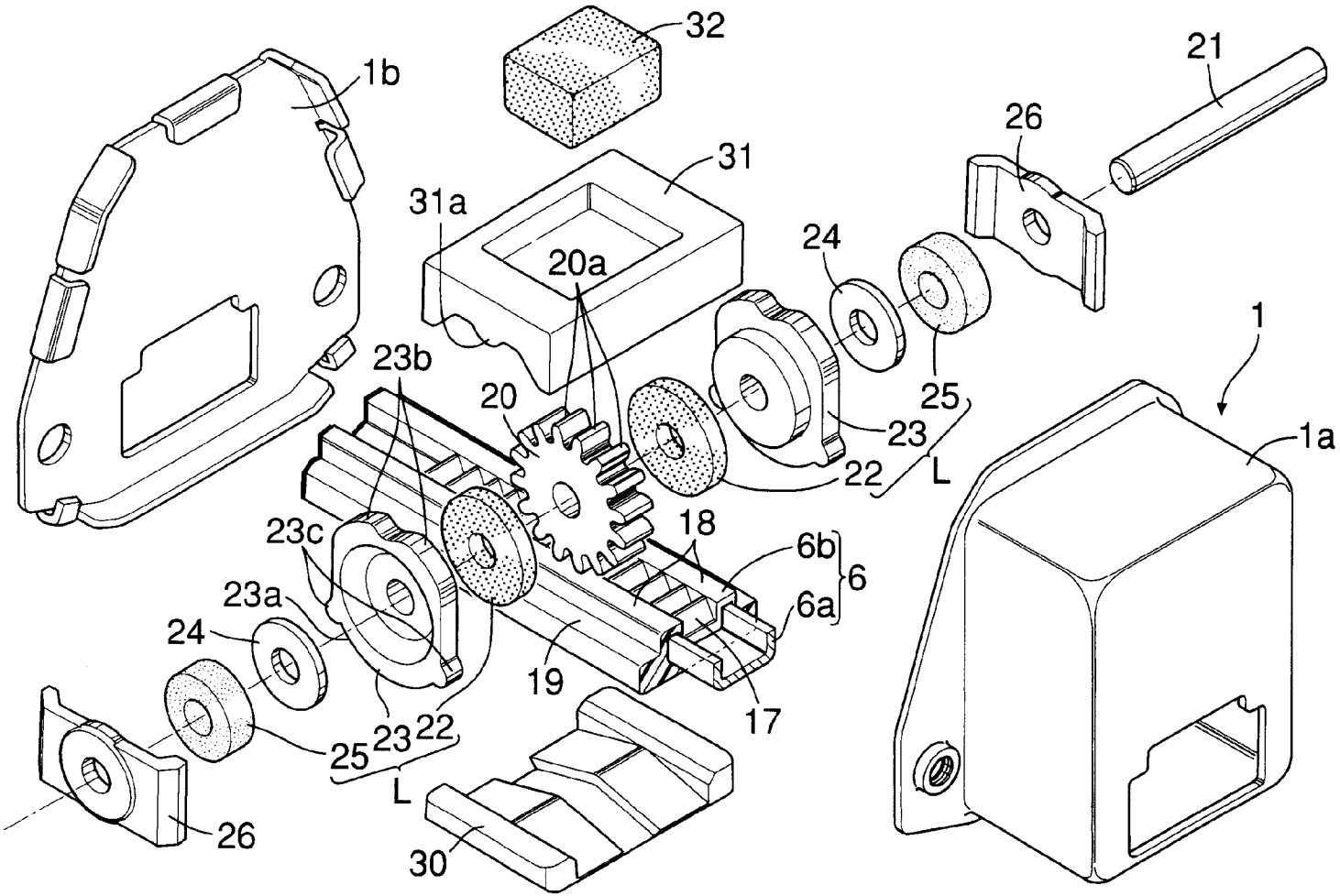
FIG. 7 is an exploded perspective view of the door checker.
Figure 12:
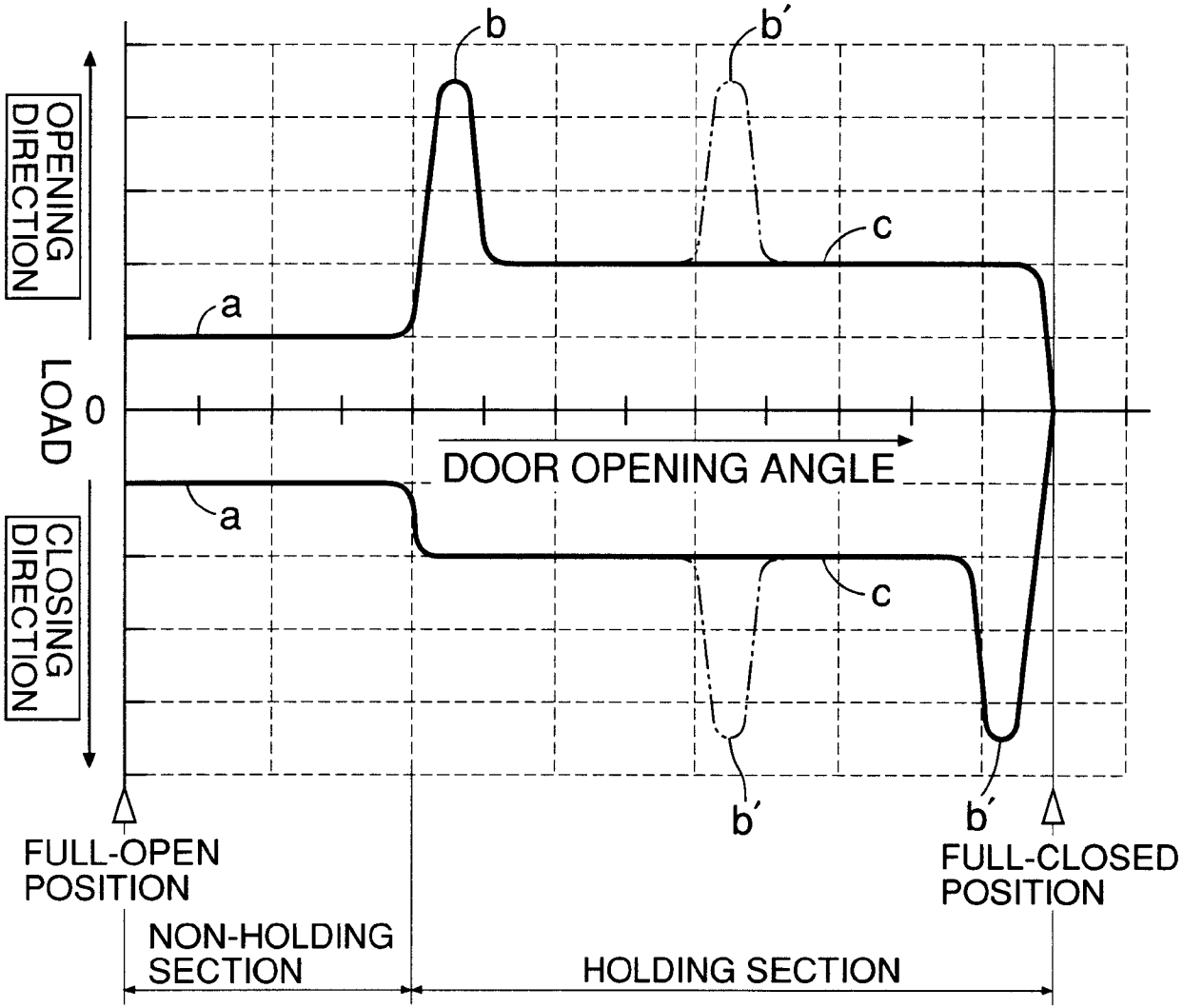
FIG. 12 is a door opening/closing load character diagram of the door checker.

As shown in FIGS. 2, 5 and 6, when the door D is between the non-holding section from the full-closed position to a predetermined small opening degree, that is, when the pinion 20 is in the non-holding section E on the side face of the check lever 6, the cam plate 23 separates the pinion 20 from the check lever 6 by being received by the rail surface 19 of the check lever 6. Therefore, when the door D is opened/closed in the non-holding section, the cam plate 23 smoothly slides on the rail surface 19 of the check lever 6, so that an opening/closing load of the door D is small (see a line a in FIG. 12). Thus, the door D can be smoothly opened/closed.

When the door D is moved from the non-holding section to the holding section, the pinion 20 is moved to the holding section F of the check lever 6, and the pinion 20 is forced to rotate by meshing with the rack 17. However, the projection 31*a* of the movable shoe 31 engaged between the tooth portions 20*a* and 20*a* of the pinion 20 resists the rotation of the pinion 20, so that the opening load of the door D is increased as shown by a line b' in FIG. 12. At this stage, the arc surface 23*a* of the cam plates 23 and 23 is raised from the rail surface 19, and the meshed state is ensured without backlash of the pinion 20 and the rack 17.

Figure 3:
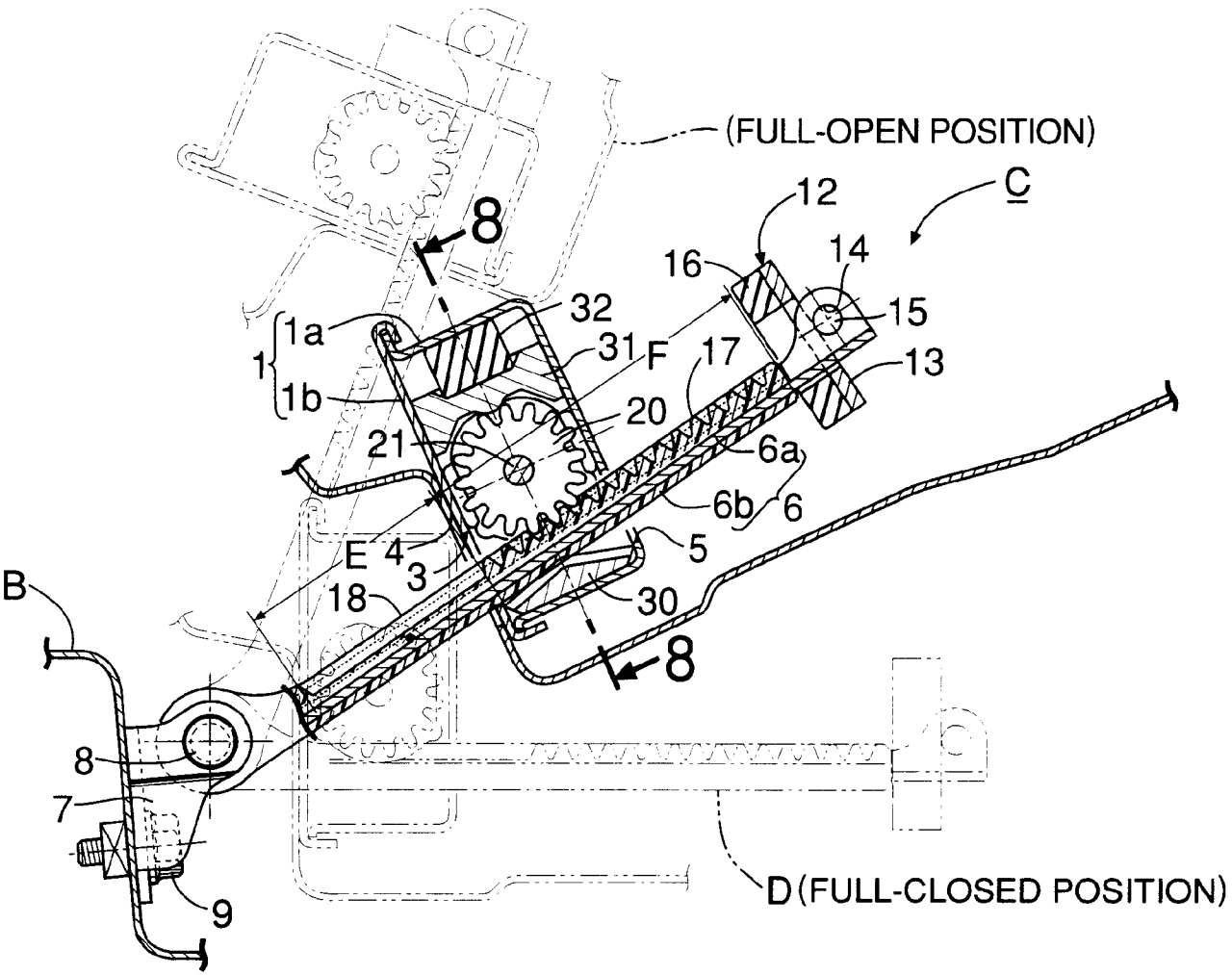
FIG. 3 is a plan view of the door checker shown in the state where the door is held.
Figure 4:
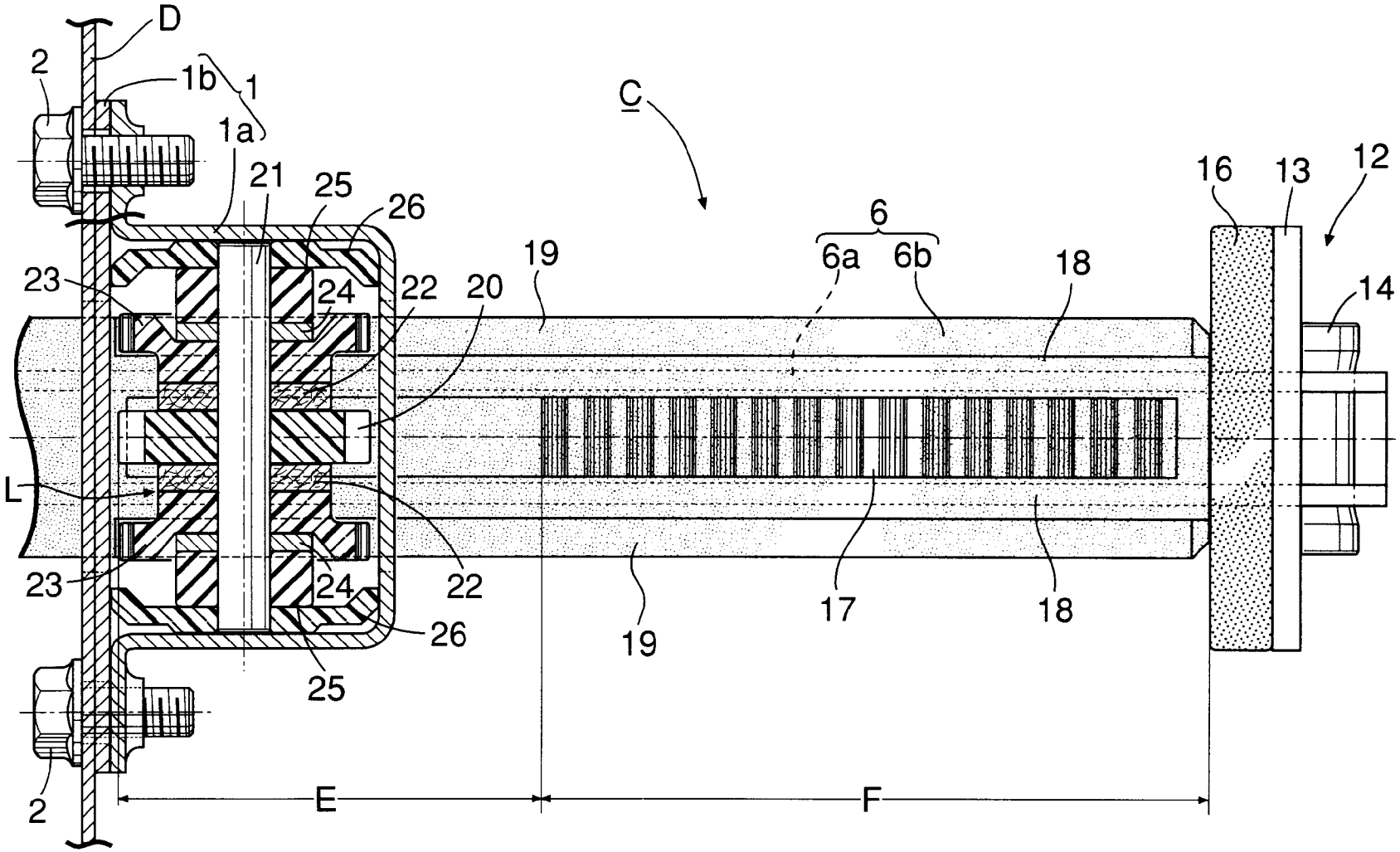
FIG. 4 is a sectional view along 4-4 line in FIG. 2.
Figure 8:
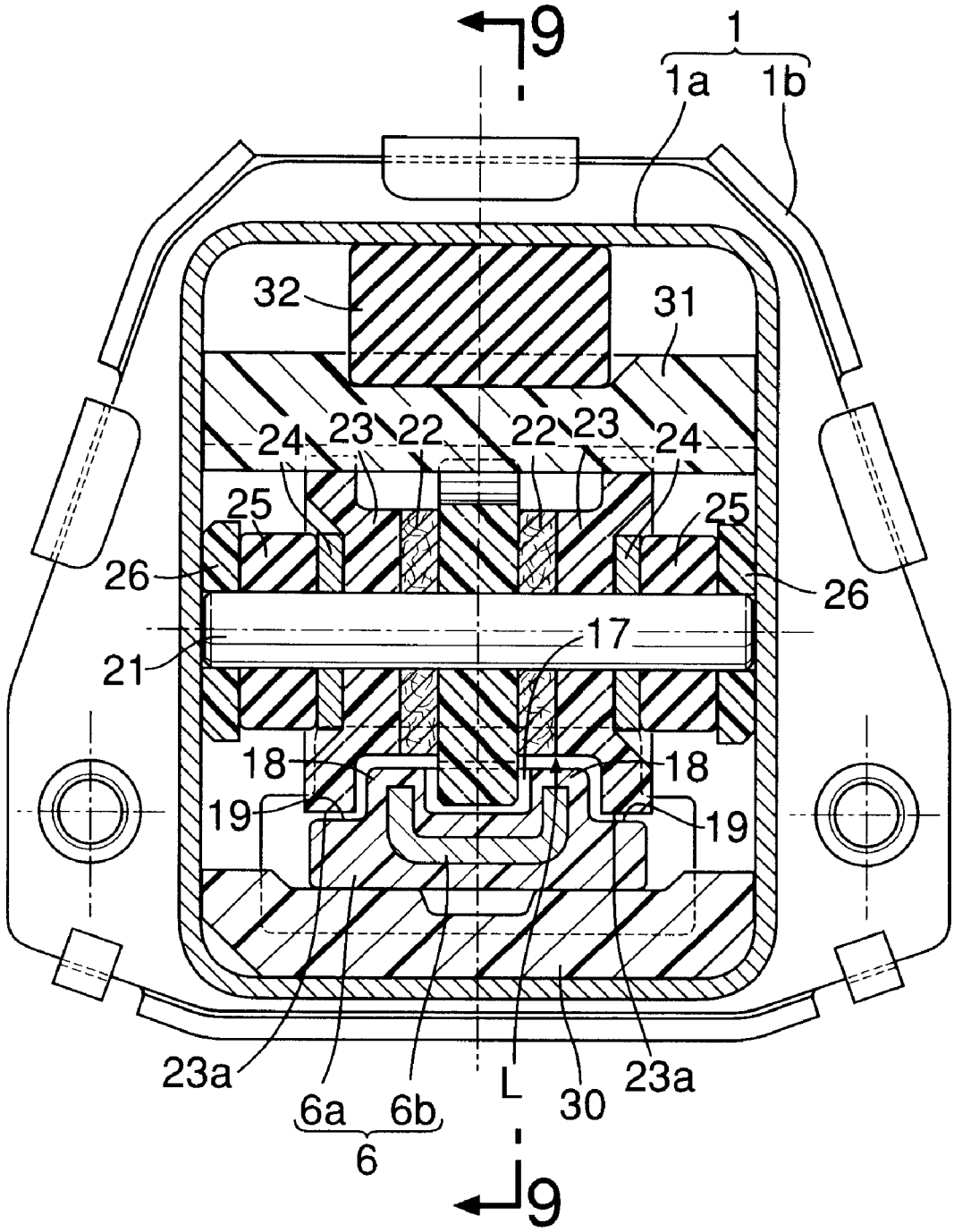
FIG. 8 is a sectional view along 8-8 line in FIG. 3.
Figure 9:
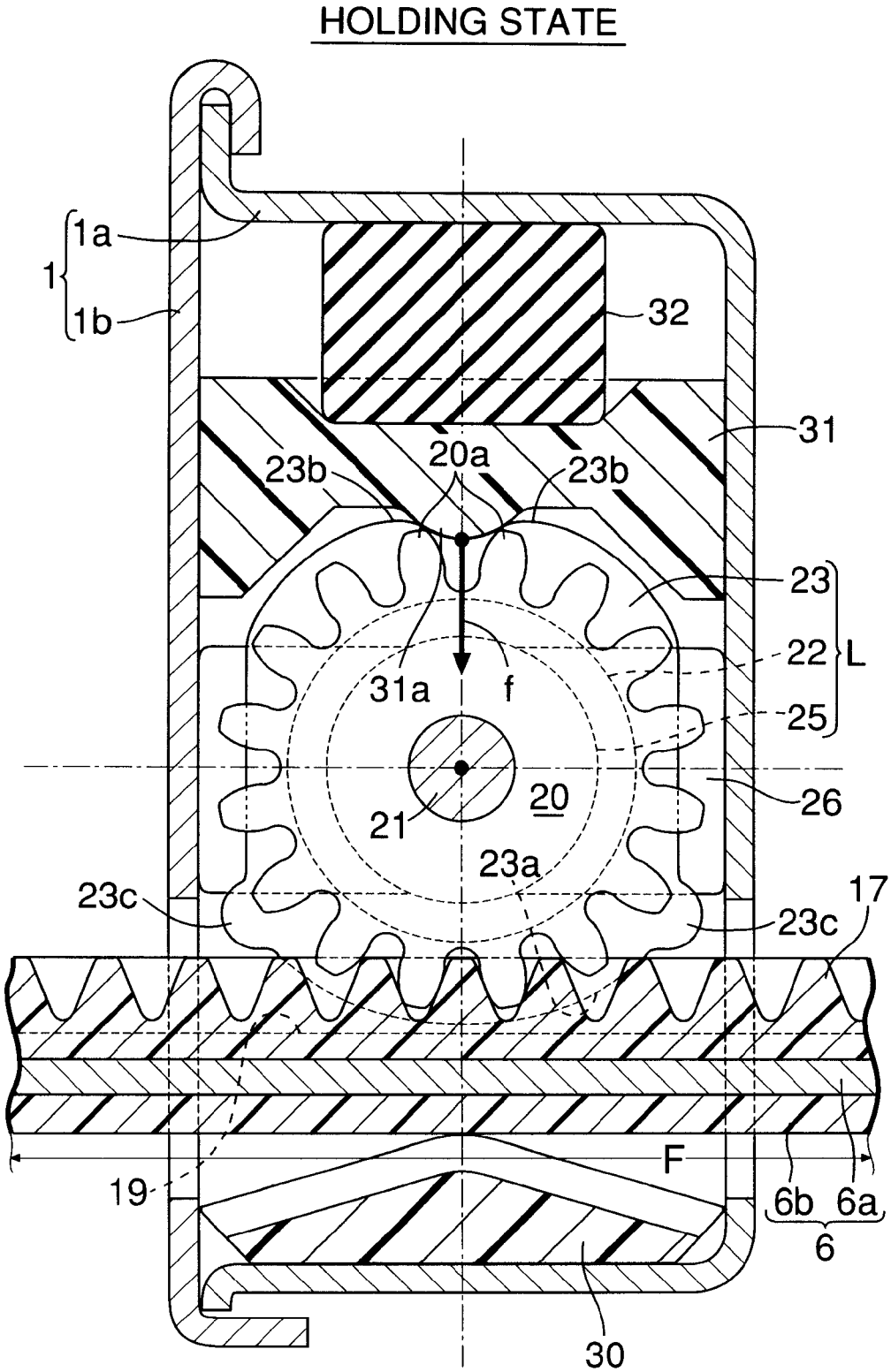
FIG. 9 is a sectional view along 9-9 line in FIG. 8.

FIGS. 3, 8 and 9 show the state where the door D is held at an intermediate opening degree of the holding section. In this state, the fixed shoe 30 and the movable shoe 31 clamp therebetween the check lever 6 and the pinion 20 meshed with the rack 17 due to pressure by a spring-back force of the check spring 32, the pinion 20 is strongly meshed with the rack 17, and the projection 31*a* of the movable shoe 31 is strongly engaged between the tooth portions 20*a* and 20*a* of the pinion 20. Therefore, the engaging force generates an opening/closing load of the door D (see a load peak portion b' in FIG. 12), and the door D cannot be opened/closed unless the load is exceeded.

At this time, the cam plates 23 and 23 receive the projection 31*a* of the movable shoe 31 between the pair of peak portions 23*b* and 23*b*.

Figure 10:
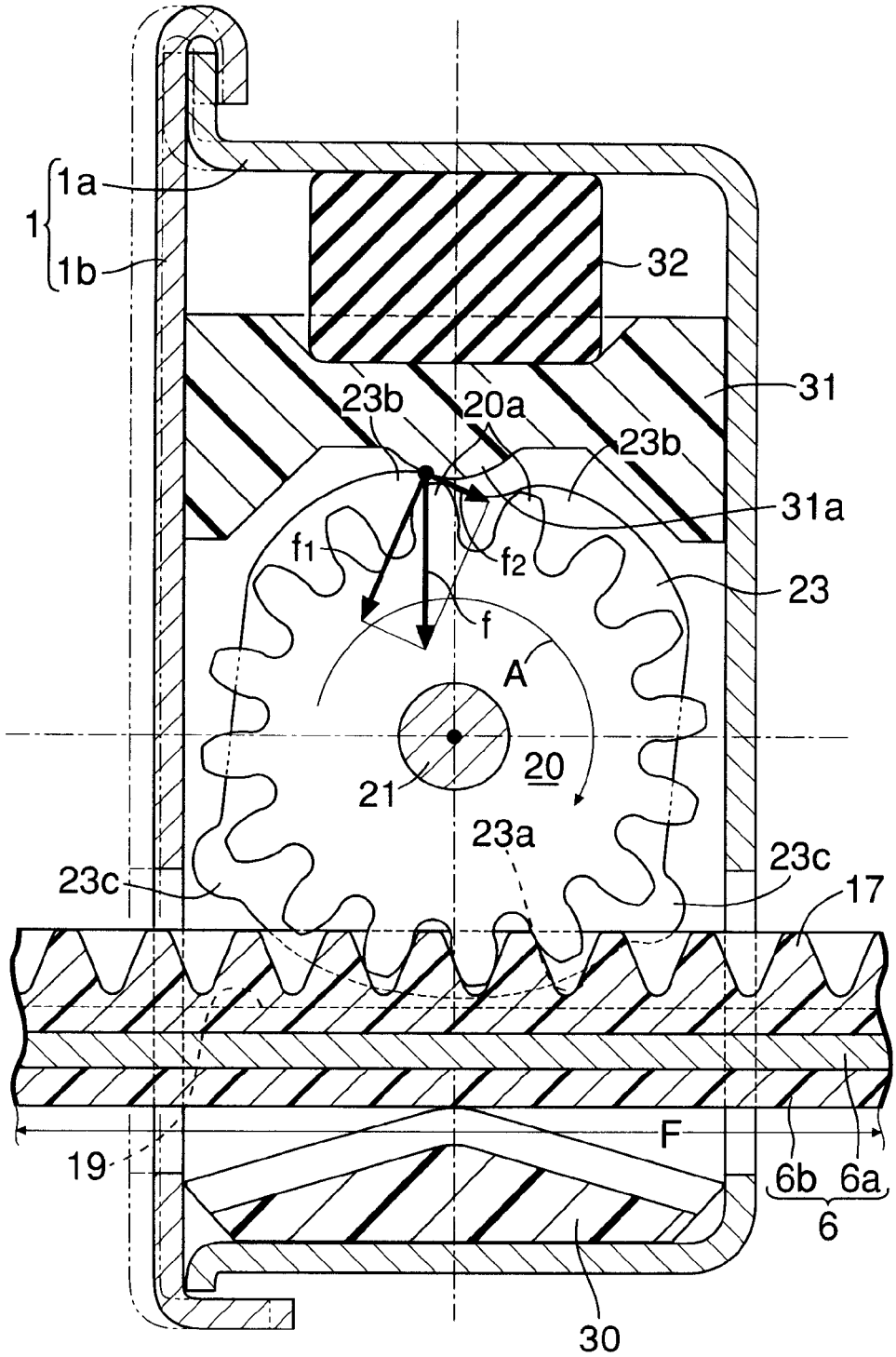
FIG. 10 is a view for explaining an operation of a cam plate of shoe pushing-up means in the above door checker.
Figure 11:
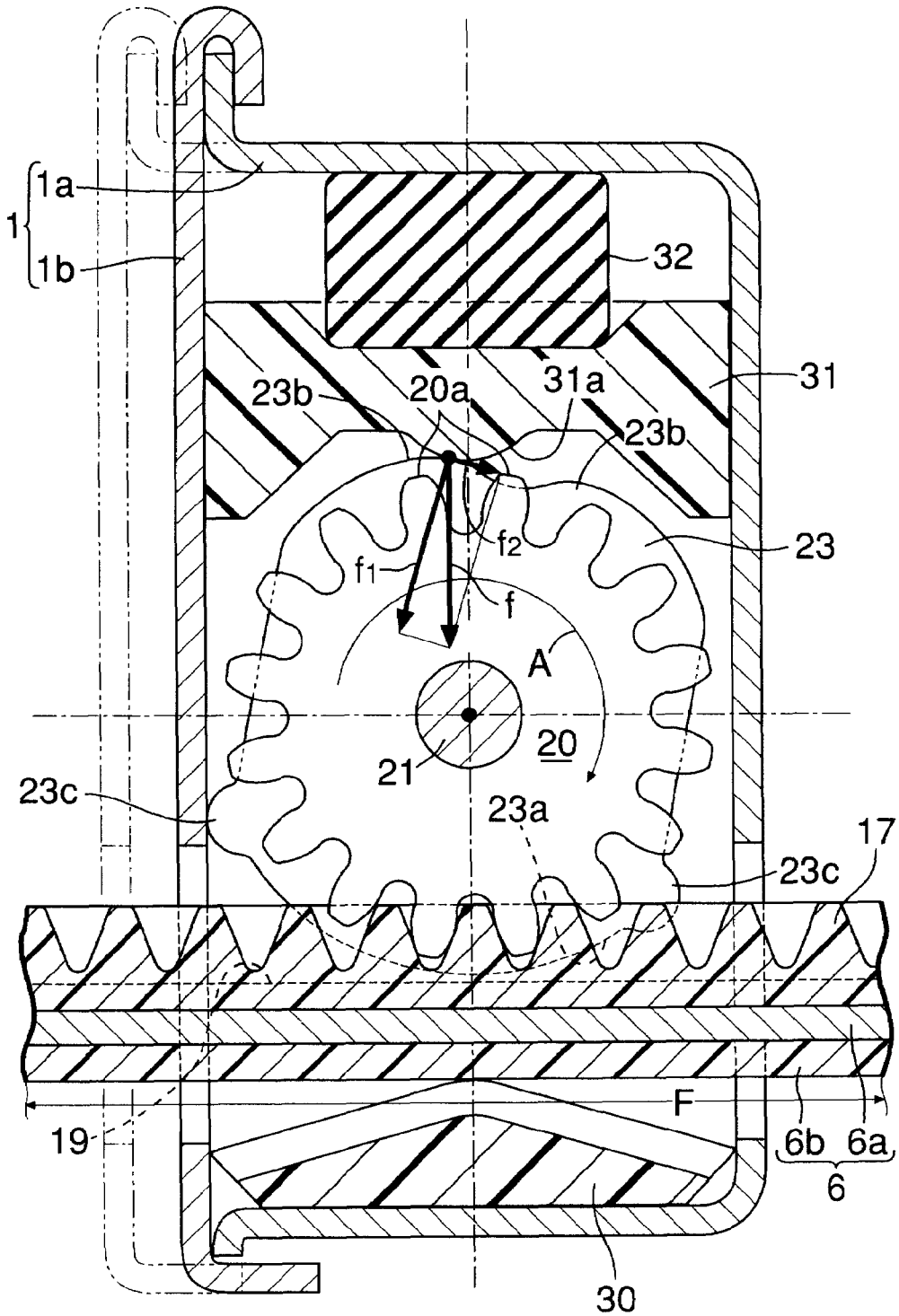
FIG. 11 is another view for explaining the operation of the cam plate.

When the door D is swung from this state in the opening direction or the closing direction within the holding section so as to move the case 1 with respect to the check lever 6 and correspondingly the pinion 20 is rotated, for example, in the direction of an arrow A, the pinion 20 rotates the cam plate 23 in the same direction through the friction plates 22 and 22. Therefore, as shown in FIG. 10, the cam plate 23 immediately scoops up the projection 31*a* of the movable 31 with the inclined surface of one of the peak portions 23*b* and separates the projection 31*a* from the tooth portion 20*a* of the pinion 20, and then, as shown in FIG. 11, one of the stopper claws 23*c* is brought into contact with the inner face of the case 1 to stop the rotation of the cam plate 23. Therefore, even if the door D is further swung and the pinion 20 is rotated by the rack 17, no contact is generated between the pinion 20 and the projection 31*a*, so that noise caused by the contact can be prevented. A swing load of the door D at that time is shown by a line c in FIG. 12, and the swing load is determined by a friction force between the pinion 20 and each of the friction plates 22.

When the swing of the door D is stopped again at another intermediate opening degree, a force f acts on the projection 31*a* of the movable shoe 31 engaged with the inclined surface of one of the peak portions 23*b* as shown in FIG. 11. That is, by the spring-back force of the set spring 25, the force f exerted by the projection 31*a* of the movable shoe 31 on the inclined surface of one of the peak portions 23*b* of the cam plate 23 is divided into a component force $f_1$ perpendicular to the inclined surface of the peak portion 23*b* and a component force $f_2$ facing the direction of the inclined surface of the peak portion 23*b*. The latter component force $f_2$ tries to guide the projection 31*a* to a space between the tooth portions 20*a* and 20*a* of the pinion 20. Thus, when the projection 31*a* begins to slide down the inclined surface, the projection 31*a* swiftly slides down the inclined surface by an inertia force of the movable shoe 31 to be engaged between the tooth portions 20*a* and 20*a* of the pinion 20 and enters a state similar to the initial state as shown in FIG. 9. Therefore, the door D can be held at the another intermediate opening degree by the strong engaging force between the projection 31*a* and the tooth portions 20*a* and 20*a* of the pinion 20 by the spring-back force of the check spring 32.

When the door D is swung in the closing direction, the pinion 20 is rotated in the direction opposite to the arrow A, and the same effect as stated above is generated except that the inclined surface of the other of the peak portions 23*b* of the cam plate 23 contributes to scooping-up of the projection 31*a*.

As described above, in the holding section of the door D, the pinion 20 is rotated by the rack 17 of the check lever 6 according to the change in opening degree of the door D, and the projection 31*a* of the movable shoe 31 can be engaged between any tooth portions 20*a* and 20*a* of the pinion 20, so that the number of steps holding the door D by the engaging force can be set to be large with ease depending on the number of teeth of the rack 17. Therefore, the door D can be held at an opening degree desired by a user.

The rotational axis of the pinion 20, that is, the pivot 21 is arranged in parallel with the axis 8 supporting the check lever 6, and thus even if the relative angle of the check lever 6 and the case 1 is changed according to the movement of the door D, the meshed state between the rack 17 in the check lever 6 and the pinion 20 in the case 1 is not disturbed, and the engagement state between the pinion 20 and the movable shoe 31 is not changed in the case 1. Therefore, irrespective of the opening degree of the door D, the door holding force can be always stabilized.

Figure 13:
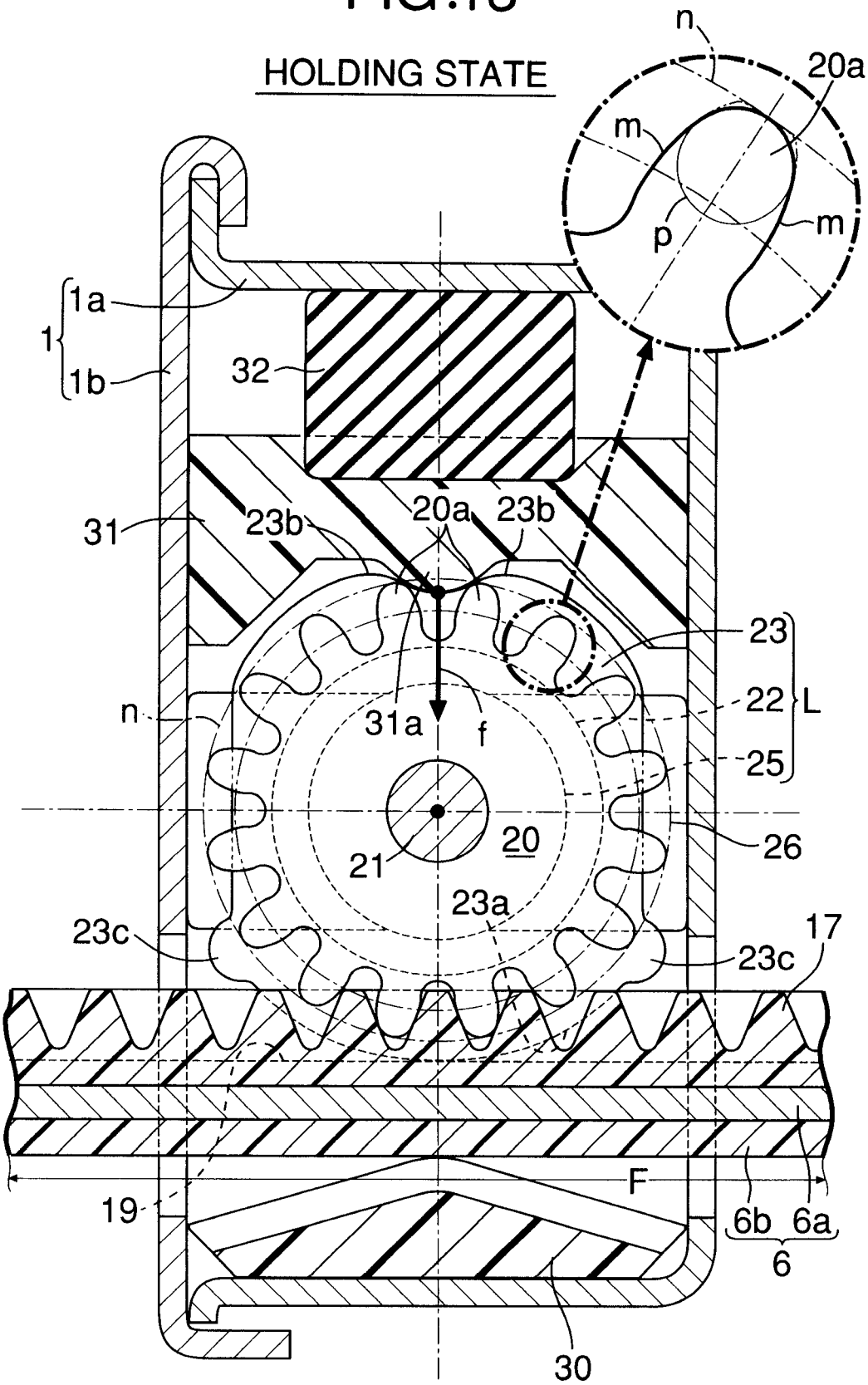
FIG. 13 is a view, corresponding to FIG. 9, of another preferred embodiment of the present invention.

Next, another preferred embodiment of the present invention will be described referring to FIG. 13.

In this preferred embodiment, even when the pinion 20 is moved in the holding section F of the check lever 6, the arc surface 23*a* of the cam plate 23 is kept in contact with the rail surface 19 so that an excessive pressure does not act on the meshed portion between the pinion 20 and the rack 17. Also, the tip end shape of the tooth portion 20*a* of the pinion 20 is formed into a circle inscribed with three curves of involute curves m and m on opposite side faces and a tooth tip end circle n, thereby smoothly carrying out engagement/disengagement of the projection 31*a* of the movable shoe 31 between the tooth portions 20*a* and 20*a*. The other components are the same as those in the previously-described embodiment, and the same reference numerals are given to portions corresponding to those in the previously-described embodiment in the drawing so as to omit duplicated explanation.

The present invention is not limited to the above-described embodiments, and various changes in design may be made without departing from the subject matter of the present invention. For example, the rack 17 to be meshed with the pinion 20 may be formed over the entire area of the check lever 6. Further, the case 1 may be fixed on the body B side and the bracket 7 of the check lever 6 may be mounted on the door D side. Furthermore, a coil spring, disk spring, etc. may be used as the check spring 32 or the set spring 25.

What is claimed is:

1. A door checker for an automobile, comprising:

a case fixed to one of a body and a door of the automobile;

a check lever movably penetrating the case, oscillatably pivotally supported by the other of the body and the door, and provided with a rack on one side face;

a pinion meshed with the rack and rotatably housed in the case;

a movable shoe housed in the case so that the movable shoe can be engaged with and disengaged from a tooth portion of the pinion;

a check spring for biasing the movable shoe in the direction of engagement with the pinion; and a shoe pushing-up means provided in the case to separate the movable shoe from the pinion with relative movement of the case and the check lever;

wherein the door is held at an arbitrary opening degree by an engaging force of the movable shoe with the pinion due to a biasing force of the check spring; and wherein the shoe pushing-up means comprises a cam plate having stopper claw that contacts an inner surface of the case to limit rotation of the cam plate caused by the pinion.

2. The door checker for an automobile according to claim 1, wherein a rotational axis of the pinion is arranged in parallel with an axis for oscillatably connecting the check lever to the other of the body and the door.

3. The door checker for an automobile according to claim 1, wherein the pinion and the cam plate are arranged coaxially to each other.

* * * * *